US010112084B2

(12) United States Patent
Stokke et al.

(10) Patent No.: US 10,112,084 B2
(45) Date of Patent: Oct. 30, 2018

(54) GOLF CLUB HEAD HAVING A SUPPORT TO LIMIT FACEPLATE DEFORMATION

(71) Applicant: Karsten Manufacturing Corporation, Phoenix, AZ (US)

(72) Inventors: Ryan M. Stokke, Anthem, AZ (US); John A. Solheim, Phoenix, AZ (US); Martin R. Jertson, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/470,369

(22) Filed: Mar. 27, 2017

(65) Prior Publication Data

US 2017/0274253 A1 Sep. 28, 2017

Related U.S. Application Data

(60) Provisional application No. 62/313,214, filed on Mar. 25, 2016.

(51) Int. Cl.

| | |
|---|---|
| ***A63B 53/04*** | (2015.01) |
| ***A63B 53/06*** | (2015.01) |
| ***A63B 60/52*** | (2015.01) |

(52) U.S. Cl.

CPC ..... *A63B 53/047* (2013.01); *A63B 60/52* (2015.10); *A63B 2053/0408* (2013.01); *A63B 2053/0416* (2013.01); *A63B 2053/0433* (2013.01); *A63B 2053/0454* (2013.01)

(58) Field of Classification Search

CPC ..... A63B 53/047; A63B 2053/0416; A63B 2053/0408; A63B 2053/0433

USPC ..... 473/324–350, 287–292

See application file for complete search history.

(56) References Cited

U.S. PATENT DOCUMENTS

| | | | | |
|---|---|---|---|---|
| 1,154,490 | A | 9/1915 | Davis | |
| 4,123,056 | A | 10/1978 | Nakamatsu | |
| 6,165,081 | A | 12/2000 | Chou | |
| 6,299,547 | B1 | 10/2001 | Kosmatka | |
| 6,835,144 | B2 | 12/2004 | Best | |
| 7,303,485 | B2 * | 12/2007 | Tseng | A63B 53/04 473/332 |
| 8,187,116 | B2 | 5/2012 | Boyd | |
| 8,317,635 | B2 | 11/2012 | Gilbert | |
| 8,342,985 | B2 * | 1/2013 | Hirano | A63B 53/047 473/331 |
| 8,425,346 | B1 | 4/2013 | Erickson | |
| 8,475,293 | B2 | 7/2013 | Morin | |
| 8,758,159 | B2 | 6/2014 | Morin | |
| 8,758,163 | B2 * | 6/2014 | Stites | A63B 53/047 473/332 |
| 8,821,313 | B1 | 9/2014 | Dawson | |
| 9,005,048 | B2 * | 4/2015 | Jertson | A63B 53/047 473/324 |
| 9,211,451 | B1 | 12/2015 | Westrum | |
| 9,381,409 | B1 | 7/2016 | Griffin | |
| 9,474,945 | B2 | 10/2016 | Fossum | |

(Continued)

*Primary Examiner* — Sebastiano Passaniti

(57) ABSTRACT

A golf club head includes a body having a face plate having a strike surface and an opposing interior surface, a rear end, and a sole connecting the faceplate with the rear end. The face plate, the rear end, and the sole partially define a cavity. An insert is positioned within the cavity, the insert presenting an insert surface facing the interior surface of the face plate and spaced therefrom.

16 Claims, 10 Drawing Sheets

(56) References Cited

U.S. PATENT DOCUMENTS

| | | | | |
|---|---|---|---|---|
| 2003/0119602 | A1* | 6/2003 | Kennedy, III | A63B 53/04 473/342 |
| 2003/0190975 | A1* | 10/2003 | Fagot | A63B 53/04 473/346 |
| 2004/0266545 | A1* | 12/2004 | Gilbert | A63B 53/04 473/291 |
| 2005/0037864 | A1* | 2/2005 | Gilbert | A63B 53/047 473/349 |
| 2007/0155534 | A1* | 7/2007 | Tsai | A63B 53/047 473/334 |
| 2010/0029406 | A1* | 2/2010 | Stites | A63B 53/047 473/334 |
| 2013/0324297 | A1 | 12/2013 | Larson | |
| 2014/0274456 | A1* | 9/2014 | Cardani | A63B 53/047 473/335 |
| 2015/0031471 | A1 | 1/2015 | Su | |
| 2015/0231458 | A1* | 8/2015 | Petersen | A63B 53/08 473/332 |

* cited by examiner

GOLF CLUB HEAD HAVING A SUPPORT TO LIMIT FACEPLATE DEFORMATION

CROSS REFERENCE TO RELATED APPLICATIONS

This claims the benefit of U.S. Provisional Application 62/313,214, filed on Mar. 25, 2016, the contents of which are fully incorporated herein by reference.

FIELD OF THE INVENTION

The present disclosure relates to a golf club, and more specifically to a support that allows for reversible elastic deformation of a golf club face plate, while also imposing a deformation limit to reduce the risk of irreversible plastic deformation.

BACKGROUND

Golf clubs take various forms, for example a wood, a hybrid, an iron, a wedge, or a putter, and these clubs generally differ in head shape and design (e.g., the difference between a wood and an iron, etc.), club head material(s), shaft material(s), club length, and club loft.

Generally, during impact with a golf ball, a golf club face plate undergoes a certain amount of deformation. More specifically, the face plate undergoes an elastic deformation in the form of deflection such that at impact with the golf ball, the face plate deflects and then rebounds in a spring-like manner. This elastic deformation increases the Coefficient of Restitution (COR). A higher COR increases the kinetic energy that is transferred to the golf ball at impact, generally increasing golf ball speed and golf ball launch distance.

In certain golf clubs, the thickness of the face plate is reduced to increase the deflection of the face plate at impact. Too much deflection of the face plate over time, however, can lead to irreversible plastic deformation. Plastic deformation of the face plate reduces the amount of elastic deformation and resulting "spring-effect" available, ultimately reducing the ability of the club head to produce optimum golf ball speed and golf ball launch distance.

While golf clubs have a variety of known designs, there is a need for allowing elastic deformation of the golf club face plate during impact with a golf ball while also imposing a limit on elastic deformation to reduce the risk of irreversible plastic deformation of the golf club face plate.

DETAILED DESCRIPTION

Figure 1:
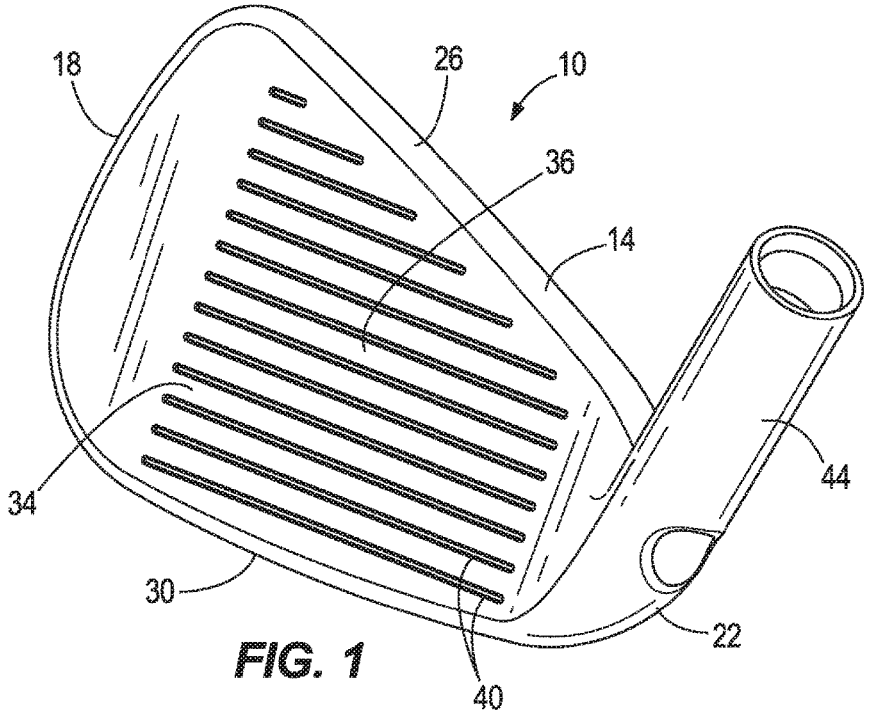
FIG. 1 is a perspective view of a golf club head that includes one or more embodiments of a delayed support as disclosed herein.
Figure 2:
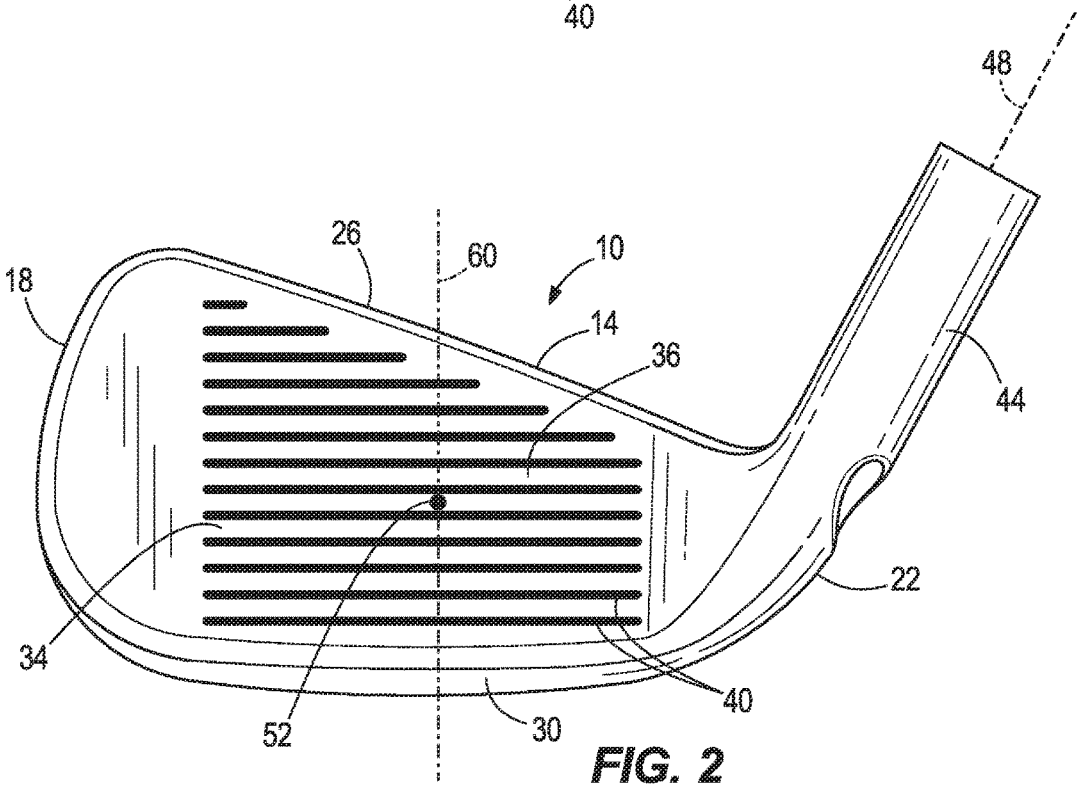
FIG. 2 is a first side view of the club head of FIG. 1, illustrating the face plate.
Figure 3:
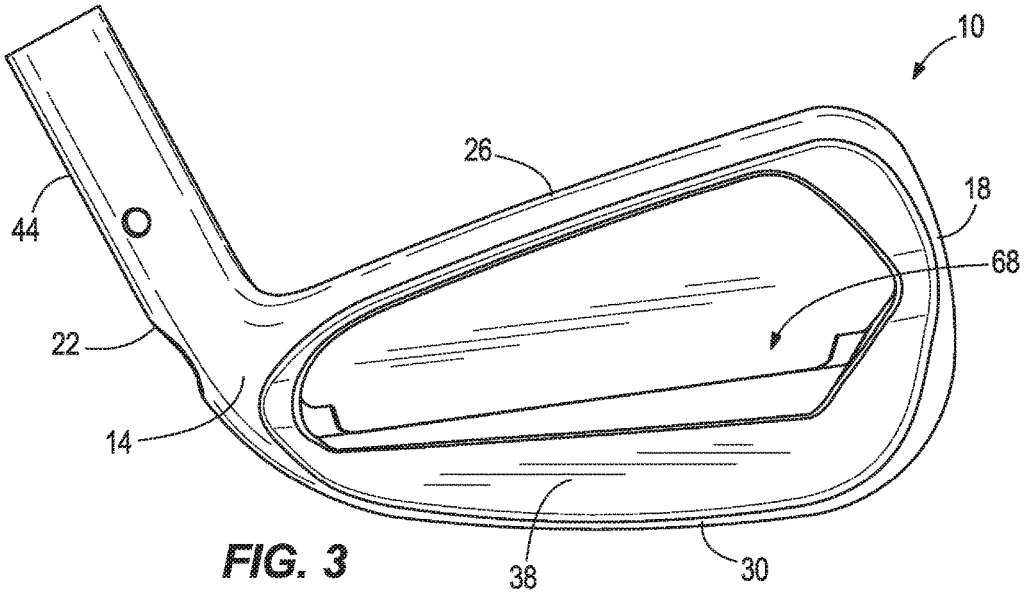
FIG. 3 is a second side view of the club head of FIG. 1, opposite the view of FIG. 2, illustrating a back side.
Figure 4:
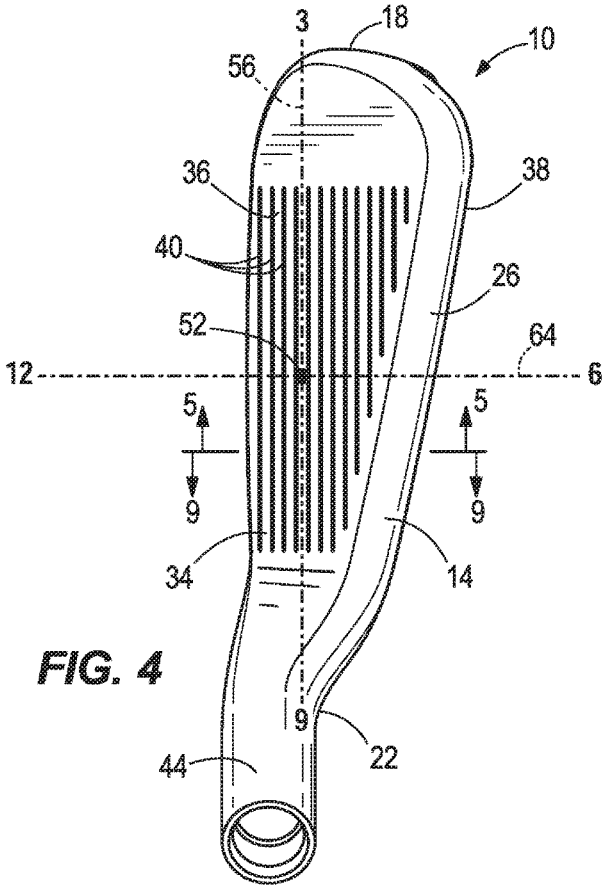
FIG. 4 is a top view of the club head of FIG. 1.

Described herein is a golf club head having a body that includes a face plate having a strike surface and an opposing interior surface, a rear end, and a sole connecting the faceplate with the rear end. The face plate, the rear end, and the sole partially define a cavity. An insert is positioned within the cavity, the insert presenting an insert surface facing the interior surface of the face plate and spaced therefrom. In many embodiments, the insert surface allows for a desired amount of deformation (or deflection) of the face plate during impact, while also reinforcing the face plate before incurring plastic deformation. In other embodiments, the insert can be spaced far enough away from the faceplate such that it does not support the face plate during impact.

In another embodiment, the golf club head includes a body having a face plate, a rear end, and a sole connecting the faceplate with the rear end. The face plate, the rear end, and the sole partially define a cavity. The rear end includes an interior surface facing the cavity. An insert is positioned within the cavity, the insert presenting an insert surface facing the interior surface of the rear end and spaced therefrom.

In another embodiment, the golf club head includes a body having a face plate having a strike surface and an opposing first interior surface, a rear end, and a sole connecting the faceplate with the rear end. The face plate, the rear end, and the sole partially define a cavity, and the rear end includes a second interior surface facing the cavity. A protrusion is coupled to one of the first interior surface and the second interior surface. The protrusion presents a contact surface facing the other of the first interior surface and the second interior surface and is spaced therefrom.

The terms "loft" or "loft angle" of a golf club, as described herein, refers to the angle formed between the club face and the shaft, as measured by any suitable loft and lie machine.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

For ease of discussion and understanding, and for purposes of description only, the following detailed description illustrates a golf club head 10 as an iron. It should be appreciated that the iron is provided for purposes of illustration of one or more embodiments of a delayed support that allows for elastic deformation of the golf club face plate during impact with a golf ball, and also imposes a limit on elastic deformation to reduce the risk of irreversible plastic deformation of the golf club face plate, as disclosed herein. The disclosed embodiments of the delayed support can be used on any desired iron, wood, hybrid, or other golf club where the face plate deforms during golf ball impact and there is a risk of elastic deformation of the face plate. For example, the club head 10 may include, but is not limited to, a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter. In addition, the golf club head 10 can have a loft that can range from approximately 3 degrees to approximately 65 degrees (including, but not limited to, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, 23.5, 24, 24.5, 25, 25.5, 26, 26.5, 27, 27.5, 28, 28.5, 29, 29.5, 30, 30.5, 31, 31.5, 32, 32.5, 33, 33.5, 34, 34.5, 35, 35.5, 36, 36.5, 37, 37.5, 38, 38.5, 39, 39.5, 40, 40.5, 41, 41.5, 42, 42.5, 43, 43.5, 44, 44.5, 45, 45.5, 46, 46.5, 47, 47.5, 48, 48.5, 49, 49.5, 50, 50.5, 51, 51.5, 52, 52.5, 53, 53.5, 54, 54.5, 55, 55.5, 56, 56.5, 57, 57.5, 58, 58.5, 59, 59.5, 60, 60.5, 61. 61.5, 62, 62.5, 63, 63.5, 64, 64.5, and/or 65 degrees).

In addition, the detailed description references one or more embodiments of a "delayed support." The delayed support describes one or more structural components that supports or reinforces a face plate during impact with a golf ball. However, the support is delayed during impact in order to allow for a desired amount of deformation or deflection of the face plate before the support reduces, limits, minimizes, or stops the deformation or deflection before incurring plastic deformation. By allowing for an amount of deformation or deflection, the face plate produces an advantageous spring-like effect.

I) Golf Club Head

Referring now to the figures, FIGS. 1-4 illustrate an embodiment of the golf club head 10 that incorporates one or more embodiments of the delayed support disclosed herein. The golf club head 10 includes a body 14 having a toe or toe end 18 opposite a heel or heel end 22. The body 14 also includes a top or top line or crown 26 opposite a sole or bottom 30. The body 14 carries a face plate or strike plate or club face 34 (shown in FIGS. 1-2 and 4) that defines a strike surface 36 (shown in FIGS. 1-2 and 4) and is opposite a rear end or back or rear or back side 38 (shown in FIGS. 3-4). A plurality of grooves 40 (shown in FIGS. 1, 2, and 4) are positioned on the face plate 34. The golf club head 10 also includes a hosel 44 having a hosel axis 48 (shown in FIG. 2) that extends through a center of the hosel 44. The hosel 44 is configured to receive a golf club shaft (not shown) that carries a grip (not shown).

The face plate 34 further comprises a thickness measured between the strike surface 36 and the first interior surface 72 of the faceplate 74. In some embodiments, the face plate 34 can have a uniform thickness. The uniform thickness can be within range of 0.025 to 0.150 inches. For example in some embodiments, the thickness can be within 0.025-0.050, 0.030-0.070, 0.040-0.090, 0.040-0.110, 0.050-0.125, 0.050-0.150, 0.60-0.150, or 0.65-0.150 inches.

In other embodiments, the face plate 34 can comprise a variable face thickness "VFT" (not shown). A face plate 34 comprising VFT can comprise greater thicknesses in regions where the face plate 34 experiences the highest stresses and can comprise lower thicknesses in regions where the face plate 34 experiences lower stresses. For example, in many embodiments, the perimeter of the face plate 34 can experience lower stresses and can comprises lower thicknesses than the center of the face plate 34 that experiences high stresses and therefore can have a greater thicknesses. In some embodiments, the VFT can have a minimum thickness of less than 0.10 inches and a maximum thickness of less than 0.25 inches. For example, in some embodiments, the minimum thickness can be less than 0.10, 0.09, 0.08, 0.07, 0.06, 0.05, 0.04, or 0.03 inches, and the maximum thickness can be less than 0.25, 0.24, 0.23, 0.22, 0.21, 0.20, 0.19, 0.18, 0.17, 0.16, 0.15, 0.14, 0.13, 0.12, 0.11, 0.10, 0.09, 0.08, 0.07, 0.06, or 0.05 inches. The thickness of the VFT region of the face plate 34 can vary between the minimum and maximum thickness.

The face plate 34 can comprise any material, such as titanium, steel, aluminum, tungsten, beryllium nickel, beryllium copper, titanium alloys, steel alloys, composites, ceramics or any combination thereof. In some embodiments, the face plate 34 can comprise materials such as 17-4 steel, 455 steel, 475 steel, 8620 steel, 1025 steel, Ti 6-4, SP 700, C300 steel, C350 steel, Ni—Co—Cr steel alloy, 565 steel, or any other suitable material. Further, in some embodiments, any of the aforementioned materials can undergo a heat treatment process to alter or achieve desired material properties.

Figure 9:
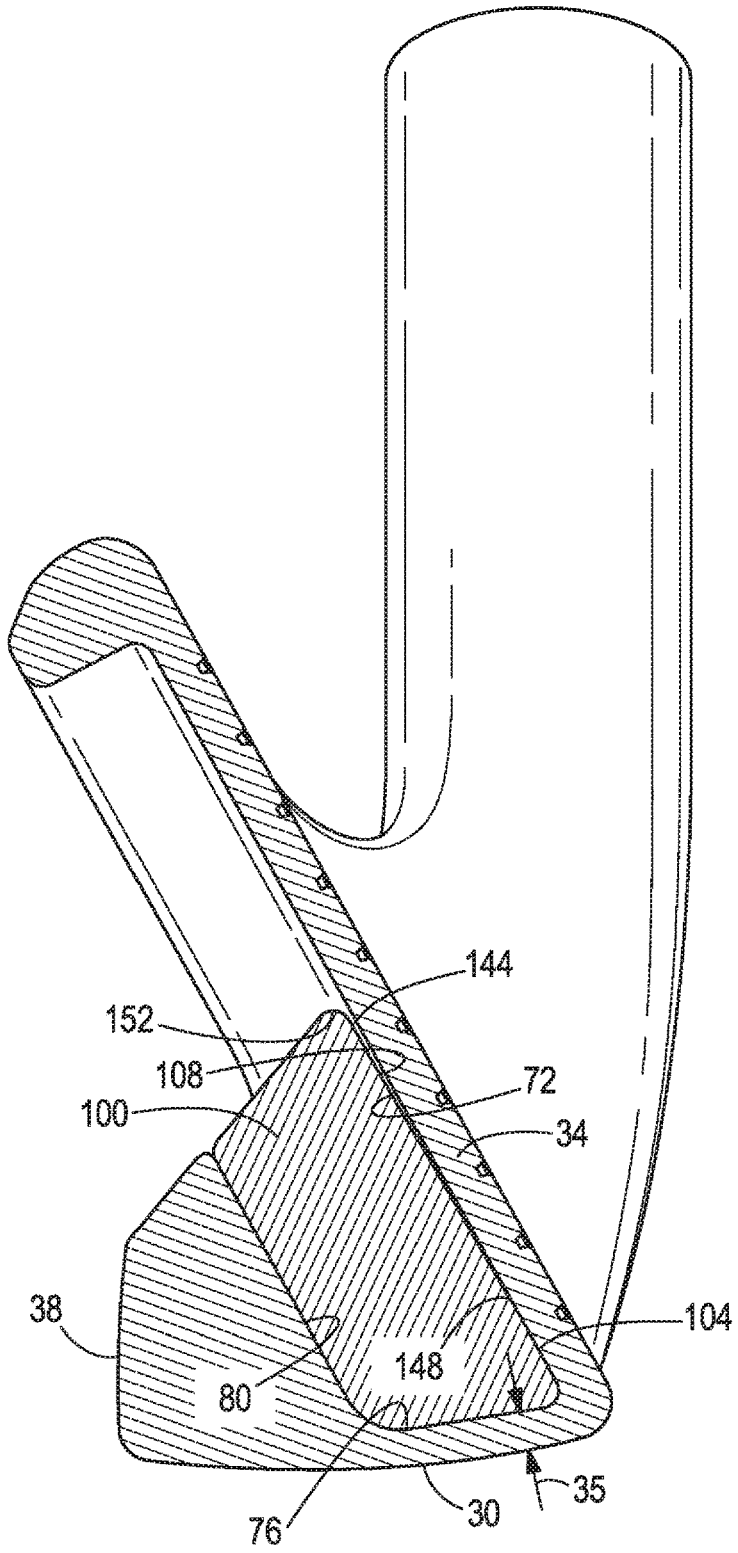
FIG. 9 is a cross-sectional view of the golf club of FIG. 1 with the insert of FIG. 6 positioned in the cavity, taken along line 9-9 of FIG. 4.

Referring to FIG. 9, the sole 30 of the club head 10 can comprise a uniform sole thickness 35 extending from near the face plate 34 toward the rear end 38. In the illustrated embodiment, the interior surface 76 of the sole 30 follows the 3-dimensional contour of the outer surface of the sole 30, such that the thickness remains the substantially constant from near the face plate 34 toward the rear end 38 and from near the toe end 18 to the heel end 22. In some embodiments, the sole thickness 35 can be within the range of 0.015-0.085 inches. In other embodiments, the sole 30 can have a uniform thickness within the range of 0.020-0.075, 0.025-0.070, 0.030-0.065, or 0.040-0.060. In other embodiments, the sole 30 can have a uniform thickness less than 0.085 inches, less than 0.080 inches, less than 0.075 inches, less than 0.070 inches, less than 0.065 inches, less than 0.060 inches, less than 0.055 inches, less than 0.050 inches, less than 0.045 inches, or less than 0.040 inches. In other embodiments, the sole 30 can have a uniform thickness of 0.015, 0.020, 0.025, 0.030, 0.035 0.040, 0.045, 0.050, 0.055, 0.060, 0.065, 0.070, 0.075, 0.080, or 0.085 inches.

In other embodiments, the sole 30 of club head 10 can comprise multiple tiers having different thicknesses (not shown). For example, in some embodiments, the sole 30 can comprise a transition region including a first tier directly adjacent to the face plate 34 having a first substantially constant thickness, and a second tier directly adjacent to the first tier, wherein the second tier comprises a second substantially constant thickness less than the first substantially constant thickness. In some embodiments, the transition region can further comprise a third tier directly adjacent to the second tier, wherein the third tier comprises a third substantially constant thickness less than the first and the second substantially constant thickness. In other embodiments, the transition region can comprise any number of tiers similar to the cascading sole disclosed in U.S. patent application Ser. No. 14/920,480.

Referring back now to FIGS. 2 and 4, the golf club head 10 includes a center of gravity or CG 52 that defines an origin of a coordinate system including an x-axis 56, a y-axis 60, and a z-axis 64. The x-axis 56 (shown in FIG. 4) extends through the club head 10 center of gravity 52 from the toe end 18 to the heel end 22. The y-axis 60 (shown in FIG. 2) extends through the club head 10 center of gravity 52 from the top 26 to the sole 30. The z-axis 64 (shown in FIG. 4) extends through the center of gravity 52 of the club head 10 from the face plate 34 to the back 38. For additional guidance in describing the innovation herein, the x-axis 56 and the z-axis 64 are arranged to coincide with numbers on an analog clock in FIG. 4. The z-axis 64 extends between 12 o'clock ("12" through the face plate 34) and 6 o'clock ("6" through the back 38), and the x-axis 56 extends between 3 o'clock ("3" through the toe end 18) and 9 o'clock ("9" through the heel end 22).

Figure 5:
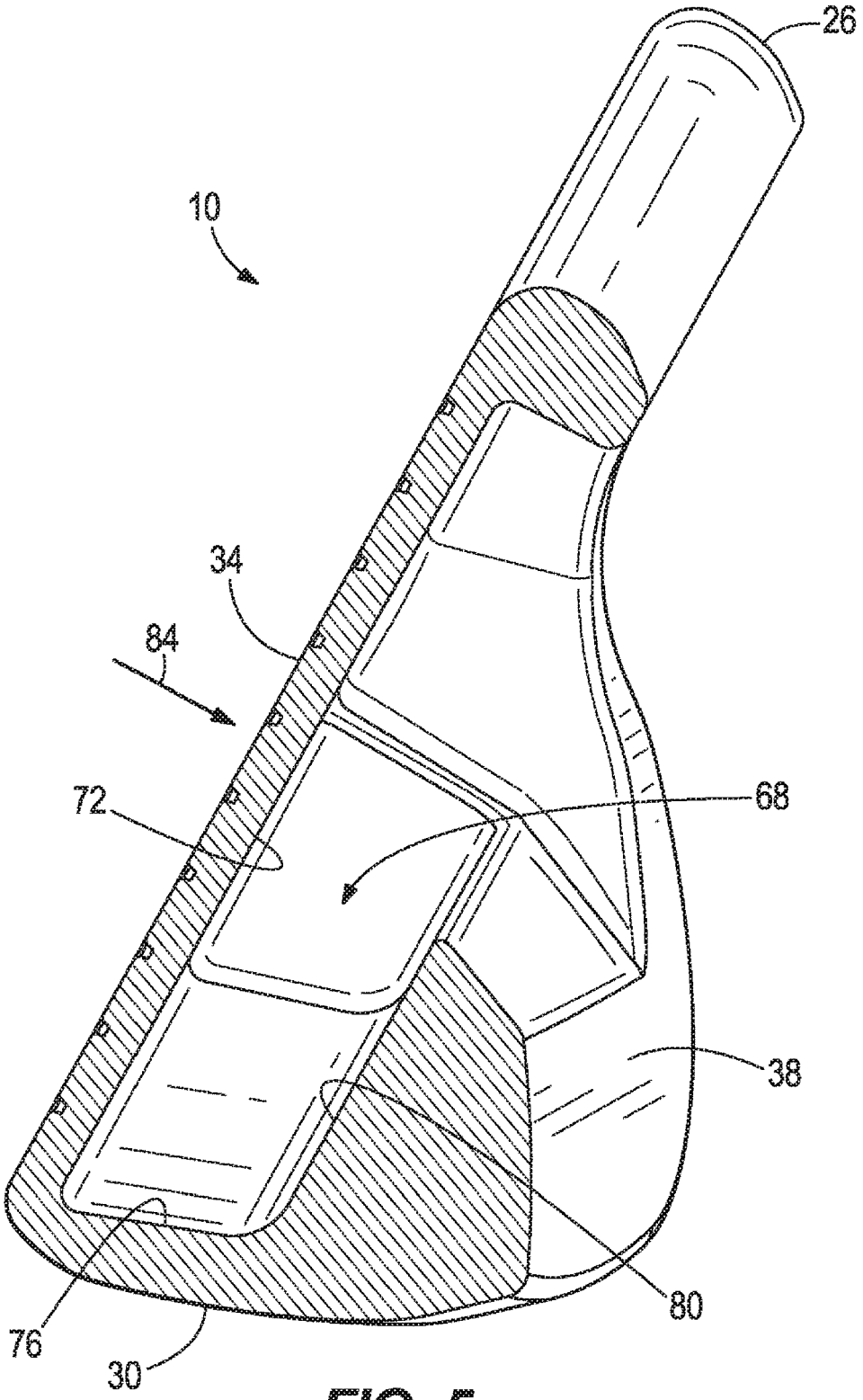
FIG. 5 is a cross-sectional view of the club head of FIG. 1, taken along line 5-5 of FIG. 4 and with the delayed support removed.

Referring now to FIG. 5, the face plate 34, the back 38 and the sole 30 of the golf club head 10 partially define a cavity 68. More specifically, a back or first interior surface 72 of the face plate 34, the interior surface or upper surface of the sole 30, and the front surface or front side or interior surface of the back 38 of the club head 10 partially define the cavity 68. It should be appreciated that to better illustrate the cavity 68, FIG. 5 illustrates the cavity 68 with the delayed support or insert removed.

During impact, the face plate 34 deforms or deflects, in an approximate travel direction 84 (shown in FIG. 5) from the face plate 34 towards the back 38. While some deflection in the direction 84 is desirable to achieve a spring-like effect, which increases golf ball speed and golf ball launch distance, too much deflection can cause plastic deformation of the face plate 34. When plastic deformation occurs, the face plate 34 has a reduced (or no) deflection, which results in less of a spring-like effect than intended, and less than optimal golf ball speed and golf ball launch distance. To provide some deflection (or elastic deformation) of the face plate 34, while also limiting the deflection to reduce the risk (or avoid) plastic deformation, the golf club head 10 includes a delayed support or insert 100.

II) Insert

Figure 6:
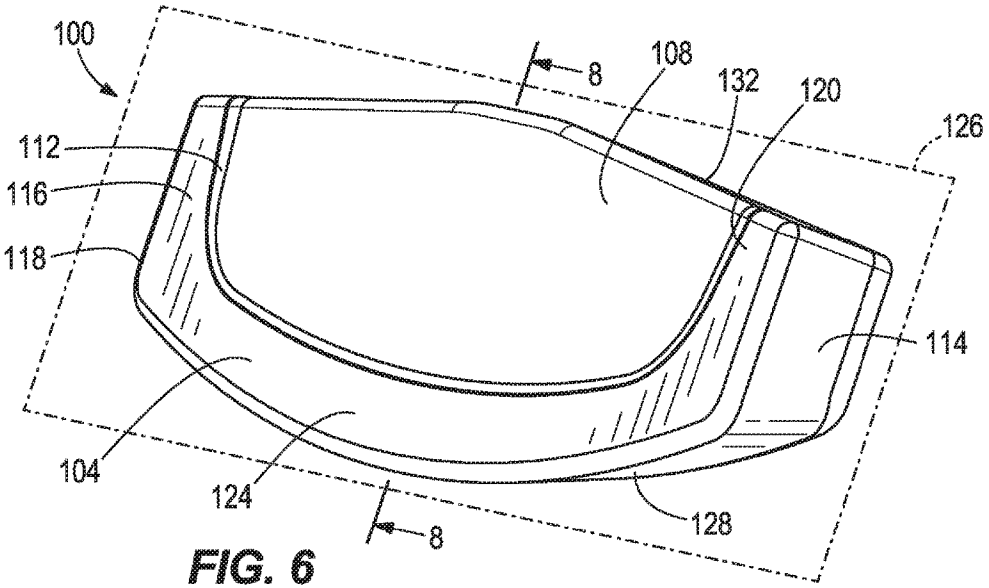
FIG. 6 is a perspective view of an embodiment of a delayed support for use with the golf club head of FIG. 1.
Figure 7:
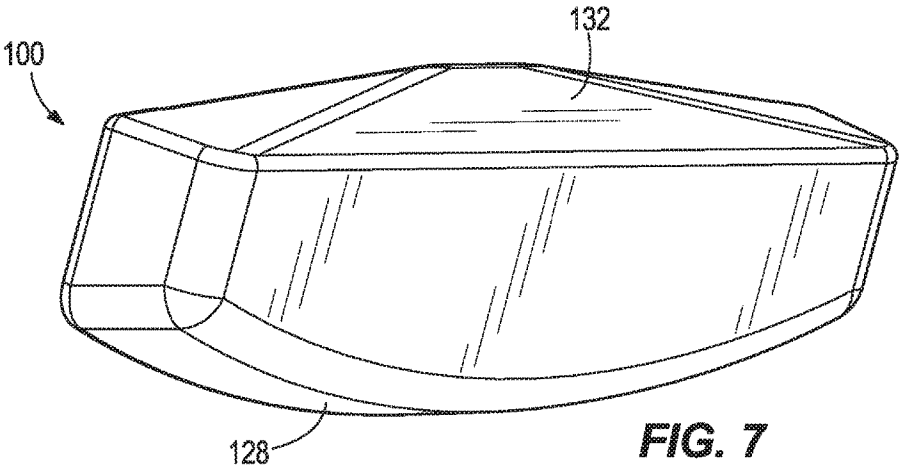
FIG. 7 is a second perspective view of the delayed support of FIG. 6, opposite the view of FIG. 6.
Figure 8:
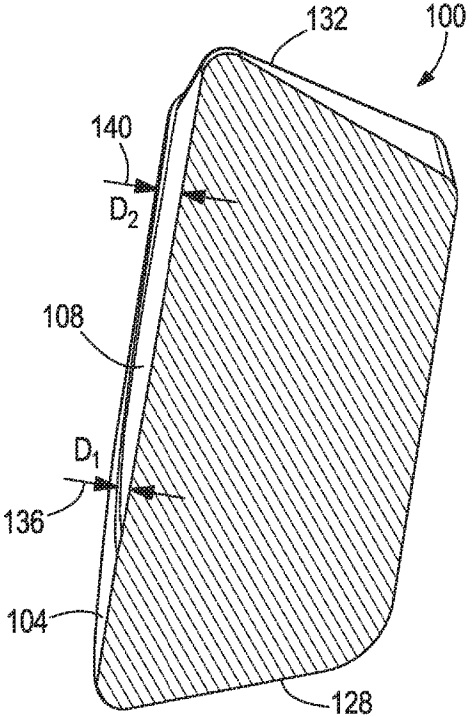
FIG. 8 is a cross-sectional view of the delayed support of FIG. 6, taken along line 8-8 of FIG. 6.

Referring to FIGS. 6-8, an embodiment of the insert 100 is illustrated. In this embodiment, the insert 100 is in the form of a custom tuning port ("CTP") weight 100 configured to be received by, or otherwise positioned in, the cavity 68. The weight 100 can be any suitable or desired insert, and can be made of one or more materials, including, but not limited to, steel, tungsten, aluminum, titanium, composites, other metal, metal alloys, polymers, plastic, and/or any combination thereof. In various embodiments, the weight 100 can be made of the same material(s) or can be made of material(s) different than the golf club head 10. In some embodiments, the weight 100 can be inserted into the cavity 68 after manufacturing of the golf club head 10. In other embodiments, the weight 100 can be formed in the cavity 68 during manufacturing of the golf club head 10 (e.g., during casting, forging, etc.), and specifically integrally formed as one piece with the remainder of the golf club head 10.

The insert 100 includes a bottom surface or first end 128 that is configured to contact the entire interior surface 76 of the sole 30, a top surface or second end 132 that is opposite the bottom surface 128, and a front portion configured to face the interior surface 72 of the face plate 34 when the insert 100 is positioned in the cavity 68. The front portion further includes a first surface or first insert surface 104 and a second surface or second insert surface 108 (shown in FIGS. 6 and 8). The first surface 104 is configured to abut the interior surface 72 of the face plate 34 during impact and is positioned adjacent to and offset from the second insert surface 108 which is configured to be spaced apart or offset from the interior surface 72 of the face plate 34 during impact. In the illustrated embodiment, an arcuate border 112 defines a transition between the first and second surfaces 104, 108. In the illustrated embodiment, the first surface 104 includes a first arm 116 adjacent to a heel end 118 of the insert 100 and a second arm 120 adjacent to a toe end 114 of the insert 100 both of which can extend at least partially from near the bottom end 128 to near the top end 132. The first surface 104 further includes a cross member 124 adjacent to the bottom end 128 of the insert 100 extending from the heel end 118 to the toe end 114. The first and second arms 116, 120 can transition into the cross member 124 near the bottom end 128 to define a generally "U" or "horseshoe" shape. Further, the arms 116, 120 and the cross member 124

(i.e., the first surface 104) may lie in a common plane 126 (shown in FIG. 6). In other embodiments, the first and second insert surfaces can comprise any shape on the front portion of the insert 100. For example, in some embodiments, the first surface 104 can be devoid of one or more of the arms 116, 120 and/or the cross member 124. For further example, in some embodiments, the first surface 104 and/or second surface 108 can form a triangular, circular, rectangular, polygonal, or any other suitable shape.

Referring again to FIG. 6, in the illustrated embodiment, the first surface 104 comprises 30% of the front portion of the insert 100. In other embodiments, the first surface 104 comprises within the range of 5%-50% of the front portion of the insert 100. For example, in some embodiments the first surface 104 can contact between 5% to 15%,10% to 20%, 15% to 25%, 20% to 30%, 25% to 35%, 30% to 40%, 35% to 45%, or 40% to 50% of the of front portion of the insert 100. Further, In the illustrated embodiment, the arms 116, 120 have a width (from heel end 118 to toe end 114) comprising 20% of the total or maximum width of the insert 100. In other embodiments, the arms 116, 120 can have a width within the range of 5% to 40% of the total or maximum width of the insert 100. For example, in some embodiments, the arms 116, 120 can comprise a width within the range of 5% to 15%, 10% to 20%, 15% to 25%, 20% to 30%, 25% to 35%, or 30% to 40% of the total or maximum width of the insert 100. Further still, in the illustrated embodiment, the cross member 124 has a height (from bottom end 128 to top end 132) comprising 20% of the total or maximum height of the insert 100. In other embodiments, the cross member 124 can have a height within the range of 5% to 50% of the total or maximum height of the insert 100. For example, in some embodiments, the cross member 124 can have a height within the range of 5% to 15%, 10% to 20%, 15% to 25%, 20% to 30%, 25% to 35%, 30% to 40%, 35% to 45%, or 40% to 50%.

In many embodiments, the insert 100 comprising one or more arms 116, 120 can beneficially prevent the insert 100 from loosening from the back side of the cavity after repeated use, as the arms 116, 120 help to maintain the position of the insert 100 within the cavity on impact with a golf ball (e.g. the arms 116, 120 can prevent the insert from shifting forward in the cavity due to the forces on impact with a golf ball).

Referring now to FIG. 8, the second surface 108 can be a sloped or tapered surface that is offset from the first surface 104. In particular, as the second surface 108 extends from near the bottom surface 128 towards the top surface 132. In the illustrated embodiment, the distance between the first surface 104 (or, alternatively, the plane 126) and the second surface 108 in a direction normal to the second surface 108 or in a direction normal to the plane 126 increases from the bottom surface 128 to the top surface 132. At a first position 136, for example, the second surface 108 is offset from the first surface 104 by a distance D1. In comparison, at a second position 140, which is closer to the top surface 132 than the first position 136 (or further from the bottom surface 128 than the first position 136), the second surface 108 is offset from the first surface 104 by a distance D2, with D2 being greater than D1.

In the illustrated embodiment, the sloped or tapered second surface 108 can include a tapering angle, defined by an angle between the second surface 108 and the plane 126. In various embodiments, the tapering angle can be greater than 0°. For example, the tapering angle can range from approximately 0.01° to approximately 20°, from approximately 0.10° to approximately 15°, from approximately 0.10° to approximately 10°, from approximately 0.10° to approximately 5°, from approximately 0.10° to approximately 2°, or from approximately 0.10° to approximately 1.5°. In some embodiments, the tapering angle can be at or less than approximately 10°, at or less than approximately 7.5°, at or less than approximately 5°, at or less than approximately 3°, at or less than approximately 2°, or at or less than approximately 1°.

Further, the distance between the second surface 108 and the plane 126 (shown in FIG. 6) in a direction normal (or perpendicular) to the plane 126 is non-constant or changes (e.g., increases or decreases) along the y-axis 60 (shown in FIG. 2) or in a direction from the top 26 to the sole 30. Stated another way, the second surface 108 is spaced from the plane 126 by the gap 144, and the width of the gap 144 changes (e.g., increases or decreases) along a portion of the second surface 108 and/or along a portion of the plane 126. Thus, a distance between the plane 126 and the second surface 108, taken normal to the plane 126, is less at a first end 148 (see FIG. 9) of the second surface 108 than at a second end 152 (see FIG. 9) of the second surface 108 (wherein the first end 148 of the second surface 108 is closer to the bottom surface 128 (shown in FIG. 6) than the second end 152).

The distance between the second surface 108 and the plane 126 (ie. the offset between the first surface 104 and the second surface 108), can range from 0.001 inches to 0.125 inches. For example, in some embodiments, the distance between the second surface 108 and the plane 126 can range from 0.005 inches to 0.125 inches, from 0.01 inches to 0.125 inches, from 0.02 inches to 0.125 inches, from 0.03 inches to 0.125 inches, from 0.04 inches to 0.125 inches, from 0.05 inches to 0.125 inches, from 0.06 inches to 0.125 inches, from 0.001 inches to 0.030 inches, from 0.001 inches to 0.040 inches, from 0.001 inches to 0.050 inches, from 0.001 inches to 0.060 inches, from 0.001 inches to 0.070 inches, from 0.001 inches to 0.080 inches, from 0.001 inches to 0.090 inches, or from 0.001 inches to 0.10 inches. In addition, the maximum distance between the second surface 108 and the plane 126 can be greater than 0.005 inches, greater then 0.020 inches, greater than 0.030 inches, greater than 0.040 inches, greater than 0.050 inches, greater than 0.060 inches, greater than 0.075 inches, greater than 0.100 inches, or greater than 0.125 inches. Further, the minimum distance between the second surface 108 and the plane 126 can be less than 0.100 inches, less than 0.075 inches, less than 0.060 inches, less than 0.050 inches, less than 0.040 inches, less than 0.030 inches, less than 0.020 inches, less than 0.010 inches, less than 0.005 inches, or less than 0.001 inches.

In other embodiments of the insert 100, the second surface 108 can be offset a uniform distance from the plane 126. Thus, the distance between the second surface 108 and the plane 126 in a direction normal (or perpendicular) to the plane 126 is constant (e.g., neither increases nor decreases) along a portion of the second surface 108. Thus the distance between the plane 126 and the second surface 108, taken normal to the plane 126, is the same near the bottom end 128 of the insert 100 and top end 132 of the insert 100.

Further, the second surface 108 can be offset a variable, non-uniform distance from the plane 126 that varies according to any profile. Thus, the distance between the second surface 108 and the plane 126 in a direction normal (or perpendicular) to the plane 126 can change at different positions along the second surface 108. For example, the distance between the second surface 108 and the plane 126 in a direction normal (or perpendicular) to the plane 126 can increase, decrease, and then increase again along the y-axis 60 or x-axis 3.

Figure 10:
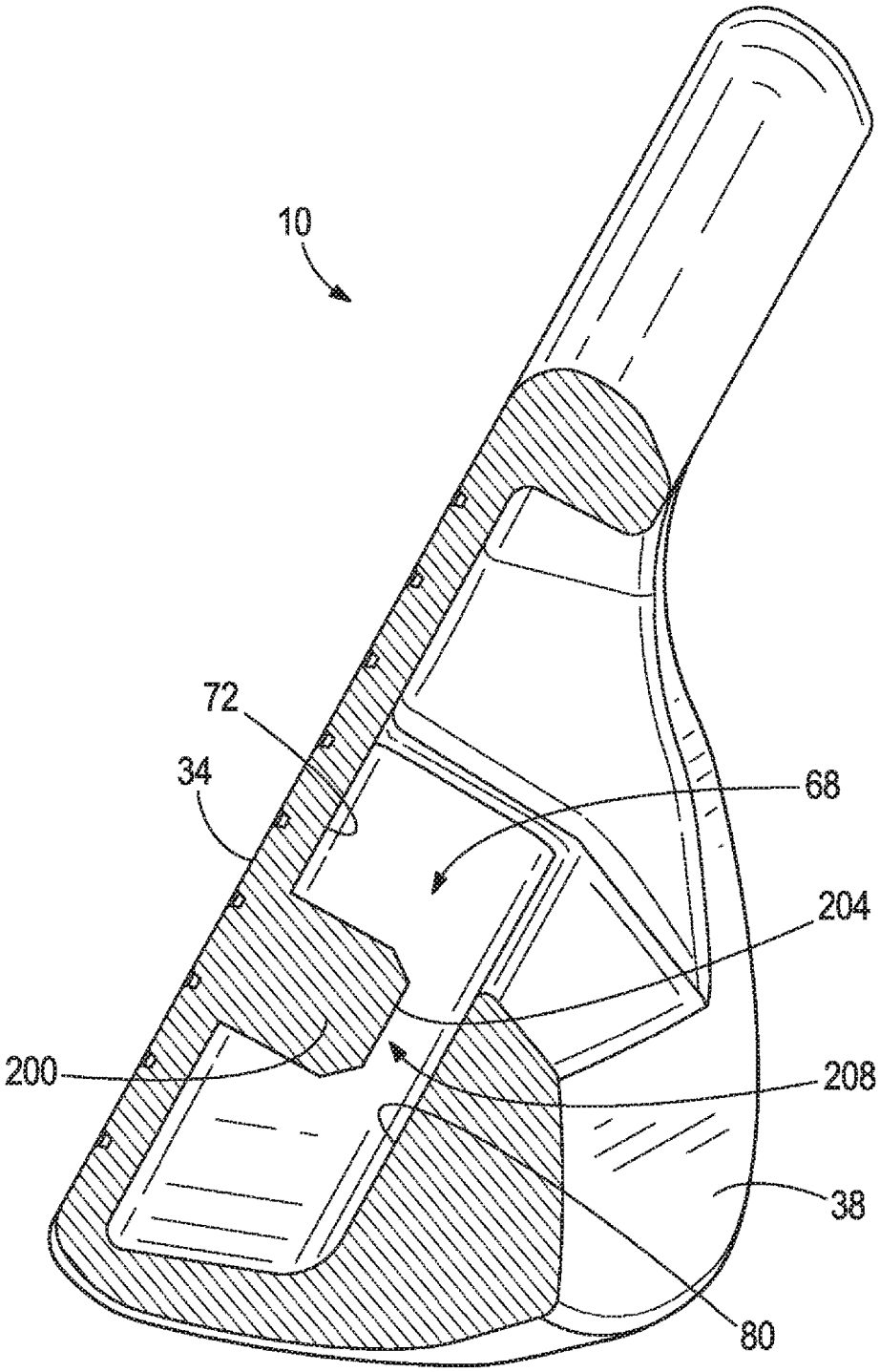
FIG. 10 is a cross-sectional view of the golf club of FIG. 1 with another embodiment of a delayed support positioned in the cavity, taken along line 5-5 of FIG. 4.

Referring now to FIG. 10, another embodiment of the club head 10 includes another embodiment of an insert 200. In this embodiment, the insert 200 is illustrated as a protrusion or projection 200 that is configured to extend into the cavity 68 from the first interior surface 72 of the face plate 34 towards the second interior surface 80 of the back end 38. The projection 200 can be any suitable length, diameter, or associated size. For example, the projection 200 can be sized to fill a portion, up to a majority of the cavity 68. Further, the projection 200 can be made of one or more materials, including, but not limited to, steel, tungsten, aluminum, titanium, composites, other metal, metal alloys, polymers, plastic, and/or any combination thereof. In various embodiments, the projection 200 can be made of the same material(s) or can be made of material(s) different than the golf club head 10. In addition, in various embodiments, the projection 200 can be coupled to or otherwise attached to the face plate 34, or the projection 200 can be integrally formed as one piece with the face plate 34 during manufacturing of the golf club head 10 (e.g., during casting, forging, etc.). In other embodiments, the projection 200 can also be positioned at any desired location on the first interior surface 72 of the face plate 34 (e.g., along the x-axis 56, y-axis 60, and/or z-axis 64). In one or more embodiments a plurality of projections 200 can be positioned at various locations on the first interior surface 72 of the face plate 34.

In the illustration of FIG. 10, the projection 200 includes a contact surface 204 that is spaced from and positioned opposite the interior surface 80 by a gap 208. The gap 208 can range from approximately 0.005 inches to approximately 0.125 inches, from approximately 0.005 inches to approximately 0.075 inches, or from approximately 0.020 inches to approximately 0.040 inches.

In other embodiments of the club head 10, the protrusion or projection 200 is configured to extend into the cavity 68 from the second interior surface 80 of the back end 38 towards first interior surface 72 of the face plate 34. The projection 200 can be any suitable length, diameter, or associated size. For example, the projection 200 can be sized to fill a portion, up to a majority of the cavity 68. In addition, in various embodiments, the projection 200 can be coupled to or otherwise attached to the back end 38, or the projection 200 can be integrally formed as one piece with the back end 38 during manufacturing of the golf club head 10 (e.g., during casting, forging, etc.). In other embodiments, the projection 200 can also be positioned at any desired location on the second interior surface 80 of the back end 38 (e.g., along the x-axis 56, y-axis 60, and/or z-axis 64). In one or more embodiments a plurality of projections 200 can be positioned at various locations on the second interior surface 80 of the back end 38.

Figure 11:
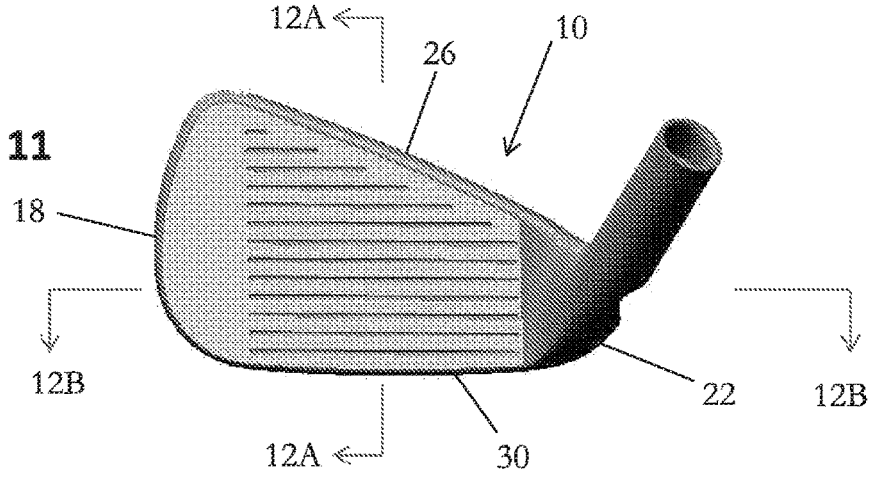
FIG. 11 is a front view of the club head of FIG. 1.
Figure 11A:
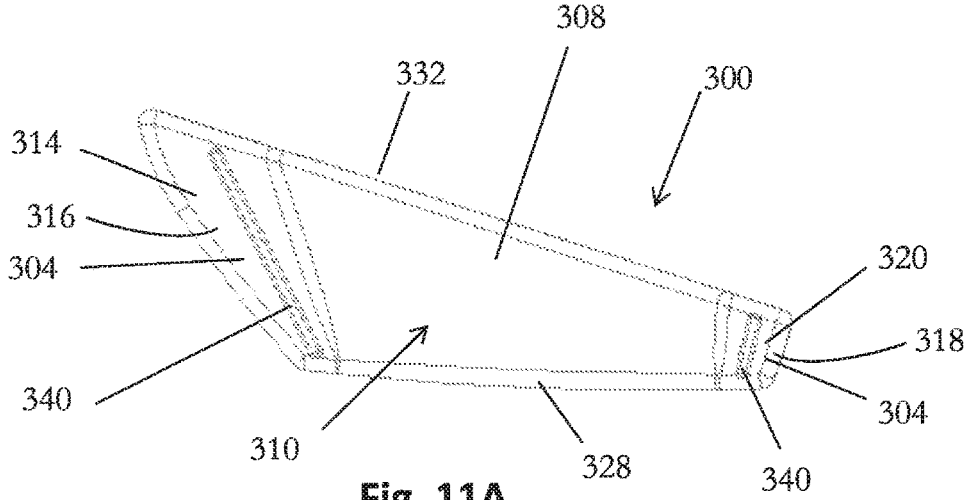
FIG. 11A is a front view of an embodiment of a delayed support for use with the golf club head of FIG. 11.
Figure 11B:
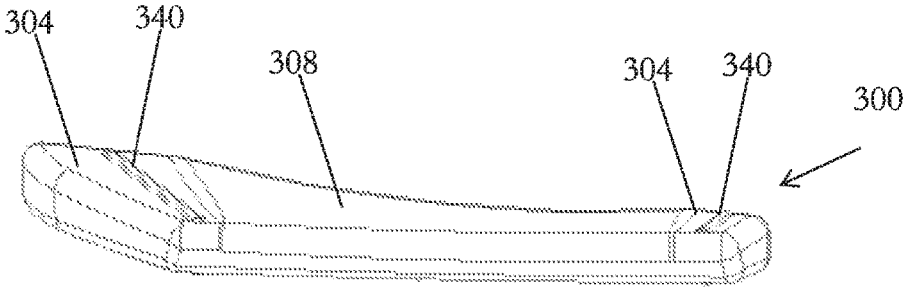
FIG. 11B is side perspective view of the delayed support of FIG. 11A.

FIGS. 11A and 11B illustrate another embodiment of an insert 300 configured to be received by, or otherwise positioned in, the cavity 68 of the club head 100 (FIG. 11). The insert 300 is similar to insert 100, with like numbers referencing like features. The insert 300 differs from insert 100 in that the front surface 310 of the insert 300 comprises a first insert surface 304 and a second insert surface 308 having different configurations.

In the illustrated embodiment, the first insert surface 304 comprises a first arm 316 extending along the toe end 314 of the insert from near the bottom surface 328 to near the top surface 332, and a second arm 320 extending along the heel end 318 of the insert from near the bottom surface 328 to near the top surface 332. The first surface 304 of the insert 300 is devoid of a cross member extending along or adjacent to the bottom surface 328 of the insert 300.

In the illustrated embodiment, the first surface 304 of the insert 300 further comprises one or more ribs 340 configured to contact the interior surface 72 of the face plate 34. In the illustrated embodiment, the first and second arm 316, 320 of the first surface 304 of the insert 300 each comprise a rib 340 extending in a direction from near the top surface 332 to near the bottom surface 328 of the insert 300. In other embodiments, the first surface 304 of the insert 300, the first arm 316 of the first surface 304, and/or the second arm 320 of the first surface 304 can comprise any number of ribs extending in any direction. In many embodiments, the one or more ribs 340 are configured to contact the interior surface 72 of the face plate 34.

Figure 11C:
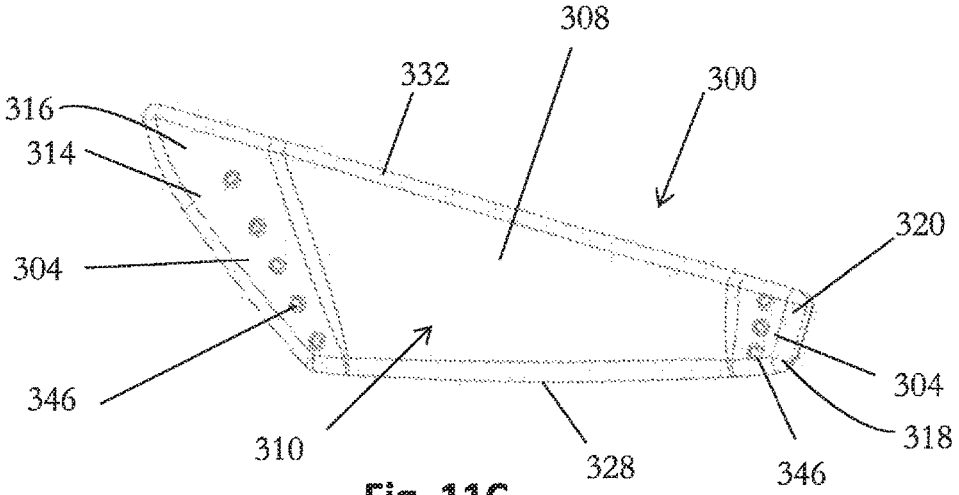
FIG. 11C is a front view of an embodiment of a delayed support for use with the golf club head of FIG. 11.
Figure 11D:
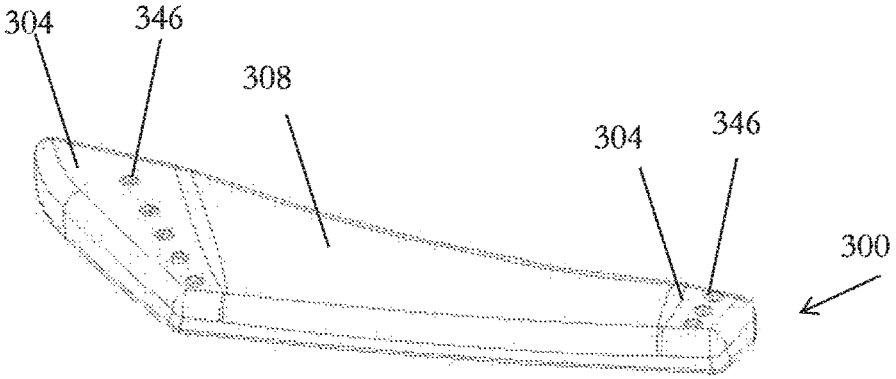
FIG. 11D is a side perspective view of the delayed support of FIG. 11C.

In other embodiments, the first insert surface 304 can comprise one or more protrusions 346 instead of, or in addition to, the one or more ribs 340. In these embodiments, the one or more protrusions 346 can be configured to contact the interior surface 72 of the face plate 34. For example, referring to FIGS. 11C and 11D, the first insert surface 304 can comprise one or more spherical protrusions 346 near the heel end 318 and one or more spherical protrusions 346 near the toe end 314. In these embodiments, the protrusions 346 can have any cross-sectional shape, such as circular, triangular, oval, square, rectangular, trapezoidal, or any other polygon or shape with at least one curved surface. Further, in some embodiments, the contact area of the protrusions 346 with the interior surface 72 of the face plate 34 can be less than the contact area of the ribs with the interior surface 72 of the face plate 34.

In the illustrated embodiment, the second surface 308 of the insert 308 comprises a curved contour, rather than a linear contour having the tapered angle of insert 100. The second surface 308 of the insert 300 is curved in a direction extending from near the bottom surface 328 of the insert 300 to near the top surface 332 of the insert, and in a direction extending from near the heel end 318 of the insert to near the toe end 314 of the insert 320. The curvature of the second surface 308 of the insert is concave relative to first surface 304 of the insert 300. In other embodiments, the second surface of the insert can vary according to any profile relative to the first surface of the insert.

III) Insert with Golf Club Head

Turning now to FIG. 9, the insert 100 in relation to the face plate 34 is illustrated. The first and second surfaces 104, 108 are positioned on a front portion of the insert 100 that faces the interior surface 72 of the face plate 34. The first surface 104 is in contact with the interior surface 72, while the second surface 108 is offset from the interior surface 72. In other embodiments, a portion of the first surface 104 can be in contact with the interior surface 72, while the second surface 108 is offset or spaced apart from the interior surface 72.

Figure 9A:
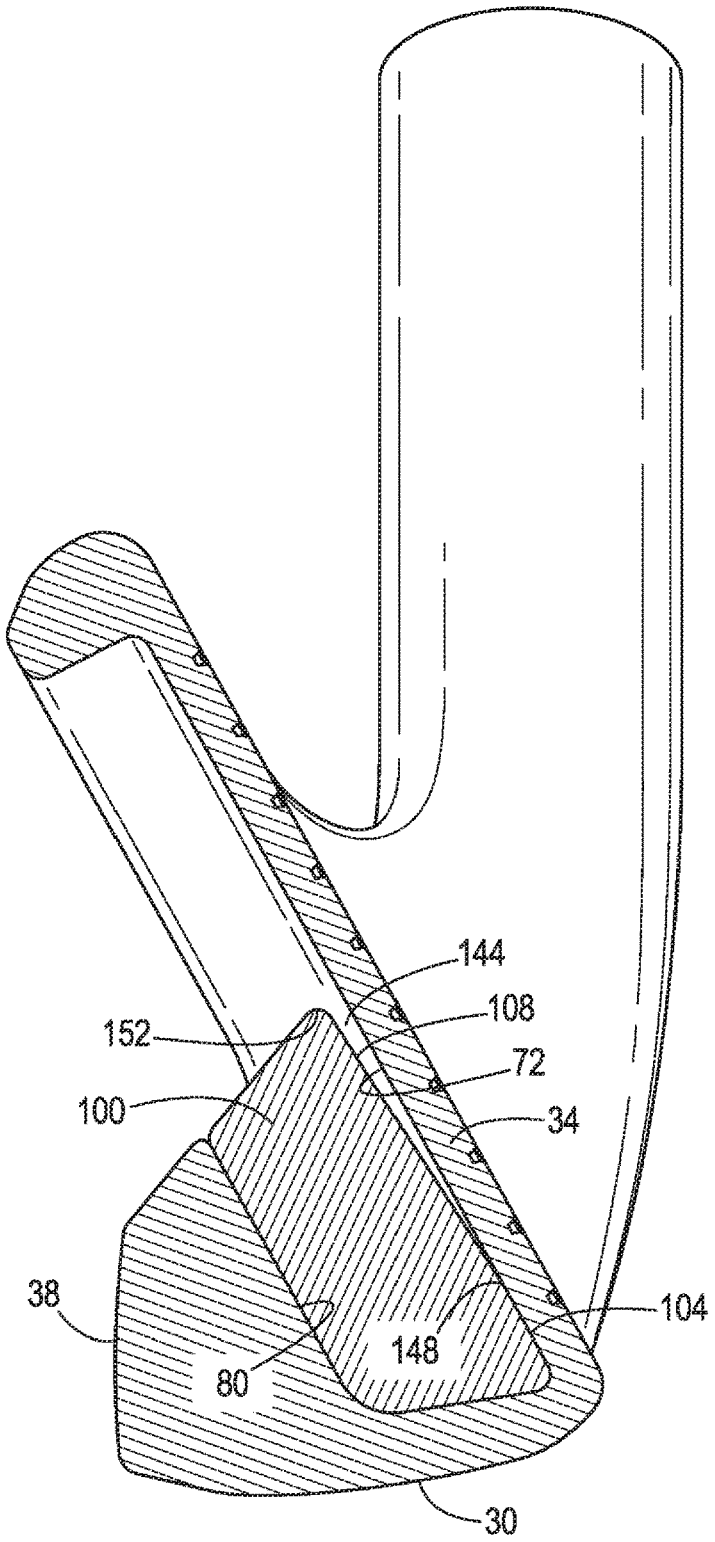
FIG. 9A is a cross-sectional view of the golf club of FIG. 1 with an embodiment of the insert of FIG. 6 positioned in the cavity, taken along line 9-9 of FIG. 4 and defining a larger gap between the insert and the face plate.
Figure 12A:
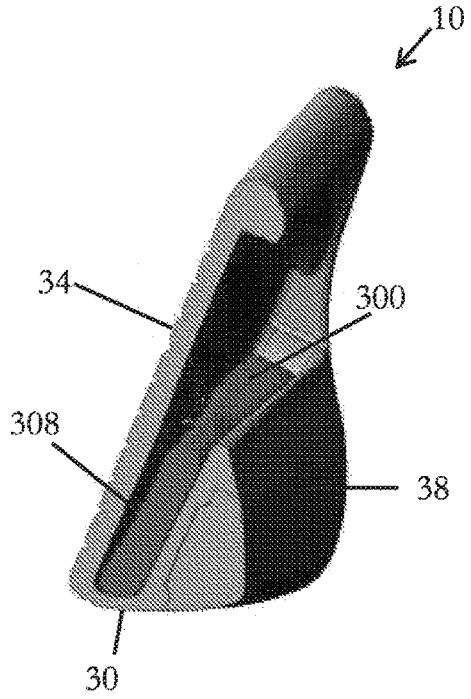
FIG. 12A is a side cross sectional view taken along line 12A-12A of the golf club head and delayed insert of FIGS. 11, 11A, and 11B.
Figure 12B:
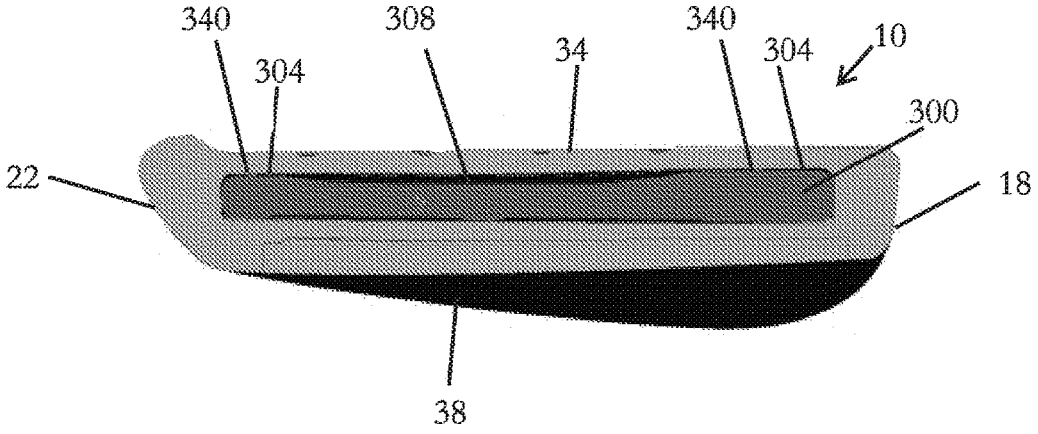
FIG. 12B is a top cross sectional view taken along line 12B-12B of the golf club head and delayed insert of FIGS. 11, 11A, and 11B.

In the illustrated embodiment of FIGS. 9 and 9A, the first surface 104 of the insert 100 contacts 25% of the portion of the interior surface 72 of the face plate 34 within the cavity. In other embodiments, the first surface 104 of the insert can contact within the range of 0.5%-30% of the portion of the interior surface 72 of the face plate 34 within the cavity. For example, in some embodiments the first surface 104 of the insert 100 can contact between 1% to 5%, between 0.5% to 10%, between 1% to 15%, between 1% to 20%, or between 1% to 25% of the portion of the interior surface 72 of the face plate 34 within the cavity. In the illustrated embodiment of FIGS. 12A and 12B, the one or more ribs 240 on the first surface 204 of the insert 100 contact 2% of the portion of the interior surface 72 of the face plate 34 within the cavity. In other embodiments, the one or more ribs 240 or protrusions 346 on the first surface 204 of the insert can contact within the range of 1%-30% of the portion of the interior surface 72 of the face plate 34 within the cavity. For example, in some embodiments the one or more ribs 240 or protrusions 346 on the first surface 204 of the insert 100 can contact between 1% to 5%, between 1% to 10%, between 1% to 15%, between 1% to 20%, or between 1% to 25% of the portion of the interior surface 72 of the face plate 34 within the cavity. In the illustrated embodiment, the sloped or tapered second surface 108 can include a tapering angle, defined by an angle between the second surface 108 and the interior surface 72 of the face plate 34. In various embodiments, the tapering angle can be greater than 0°. For example, the tapering angle can range from approximately 0.01° to approximately 20°, from approximately 0.10° to approximately 15°, from approximately 0.10° to approximately 10°, from approximately 0.10° to approximately 5°, from approximately 0.10° to approximately 2°, or from approximately 0.10° to approximately 1.5°. In some embodiments, the tapering angle can be at or less than approximately 10°, at or less than approximately 7.5°, at or less than approximately 5°, at or less than approximately 3°, at or less than approximately 2°, or at or less than approximately 1°. In the illustrated embodiments, the sloped or tapered second surface 108 can include a slope rate or tapering rate or gradient. As illustrated in FIGS. 9-9A, the slope rate of the second surface 108 is negative (decreasing as viewed from left to right). Accordingly, in various embodiments, the slope rate can range from approximately −0.005 to approximately −0.500, from approximately −0.010 to approximately −0.400, from approximately −0.015 to approximately −0.300, from approximately −0.015 to approximately −0.200, or from approximately −0.020 to approximately −0.200. In some embodiments, the slope rate of the second surface 108 can be at or more than approximately −0.400 (e.g., −0.390, −0.385, etc.), at or more than approximately −0.300 (e.g., −0.290, −0.285, etc.), or at or more than approximately −0.200 (e.g., −0.190, −0.185, etc.). In other embodiments, the slope rate of the second surface 108 can be positive (increasing as viewed from left to right, such as the view provided in FIG. 5). Accordingly, in various embodiments, the slope rate can range from approximately 0.005 to approximately 0.500, from approximately 0.010 to approximately 0.400, from approximately 0.015 to approximately 0.300, from approximately 0.015 to approximately 0.200, or from approximately 0.020 to approximately 0.200. In some embodiments, the slope rate of the second surface 108 can be at or less than approximately 0.400 (e.g., 0.390, 0.385, etc.), at or less than approximately 0.300 (e.g., 0.290, 0.285, etc.), or at or less than approximately 0.200 (e.g., 0.190, 0.185, etc.).

In the illustrated embodiment, the distance between the second surface 108 and the interior surface 72 in a direction normal (or perpendicular) to the interior surface 72 is non-constant or changes (e.g., increases or decreases) along the y-axis 60 or in a direction from the top 26 to the sole 30. Stated another way, the second surface 108 is spaced from the interior surface 72 by a gap 144, and the width of the gap 144 changes (e.g., increases or decreases) along a portion of the second surface 108 and/or along a portion of the interior surface 72 to define a sloped second surface 108. Thus, a distance between the interior surface 72 and the second surface 108, taken normal to the interior surface 72, is less at a first end 148 of the second surface 108 than at a second end 152 of the second surface 108 (wherein the first end 148 of the second surface 108 is closer to the sole 30 than the second end 152).

The distance between the second surface 108 and the interior surface 72 of the face plate 34, (i.e., the width of the gap 144) can range from approximately 0.001 inches to approximately 0.125 inches. For example, in some embodiments, the distance between the second surface 108 and the interior surface 72 of the face plate 34 can range from 0.005 inches to 0.125 inches, from 0.01 inches to 0.125 inches, from 0.02 inches to 0.125 inches, from 0.03 inches to 0.125 inches, from 0.04 inches to 0.125 inches, from 0.05 inches to 0.125 inches, from 0.06 inches to 0.125 inches, from 0.001 inches to 0.030 inches, from 0.001 inches to 0.040 inches, from 0.001 inches to 0.050 inches, from 0.001 inches to 0.060 inches, from 0.001 inches to 0.070 inches, from 0.001 inches to 0.080 inches, from 0.001 inches to 0.090 inches, or from 0.001 inches to 0.10 inches. In addition, the maximum distance between the second surface 108 and the interior surface 72 of the face plate 34 can be greater than 0.005 inches, greater than 0.020 inches, greater than 0.030 inches, greater than 0.040 inches, greater than 0.050 inches, greater than 0.060 inches, greater than 0.075 inches, greater than 0.100 inches, or greater than 0.125 inches. Further, the minimum distance between the second surface 108 and the interior surface 72 of the face plate 34 can be less than 0.100 inches, less than 0.075 inches, less than 0.060 inches, less than 0.050 inches, less than 0.040 inches, less than 0.030 inches, less than 0.020 inches, less than 0.010 inches, less than 0.005 inches, or less than 0.001 inches FIGS. 9 and 9A illustrate embodiments of the insert 100 having a different maximum distance between the second surface 108 and the interior surface 72 of the face plate 34. The exemplary insert 100 illustrated in FIG. 9A comprises a larger maximum distance between the second surface 108 and the interior surface 72 of the face plate 34 than the exemplary insert illustrated in FIG. 9A.

In the embodiment illustrated in FIGS. 9, 9A, 12A, and 12B, the distance between the second surface 108 and the interior surface 72 of the face plate 34, taken normal to the interior surface 72, increases along the second surface 108 the further away from the sole 30 (or closer to the crown 26) and toward the center of the face plate 34. In these embodiments, the maximum distance between the second surface 108 and the interior surface 72 of the face plate 34 is positioned near the center of the face, which experiences the most bending on impact with a golf ball. Positioning the maximum distance near the center of the face allows increased face deflection near the center of the face, and/or prevents restriction of bending near the center of the face. Accordingly, the face bending that is maintained or increased centrally on the face can be transferred to a golf ball on impact, thereby increasing ball speed and travel distance, compared to a club head having an insert positioned adjacent to the back and near the center of the face.

In other embodiments, the insert 100 can be repositioned along the y-axis 60 within or partially outside of the cavity 68, and the first end 148 can be positioned further away from the sole 30 than the second end 152. Thus, the distance between the second surface 108 and the interior surface 72 of the face plate 34, taken normal to the interior surface 72, decreases along the second surface 108 with increasing distance from the sole 30 (or closer to the crown 26).

In other embodiments of the club head 10, the second surface 108 can be offset a uniform distance from the interior surface 72 of the face plate 34. Thus, the distance between the second surface 108 and the interior surface 72 in a direction normal (or perpendicular) to the interior surface 72 is constant (e.g., neither increases nor decreases) along a portion of the second surface 108. Thus the distance between the interior surface 72 and the second surface 108, taken normal to the interior surface 72, is the same at a first end 148 of the second surface 108 and at a second end 152 of the second surface 108.

In other embodiments of the club head 10, the second surface 108 can be offset a variable, non-uniform distance from the interior surface 72 of the face plate 34. Thus, the distance between the second surface 108 and the interior surface 72 in a direction normal (or perpendicular) to the interior surface 72 can change at different positions along the x-axis 56, y-axis 60, and/or z-axis 64. For example, the distance between the second surface 108 and the interior surface 72 in a direction normal (or perpendicular) to the interior surface 72 can increase, decrease or remain the same along the x-axis 56, y-axis 60, and/or z-axis 64. In some embodiments, the distance between the second surface 108 and the interior surface 72 in a direction normal (or perpendicular) to the interior surface 72 can increase, decrease, and then increase again along the y-axis 60. In other embodiments, the distance between the second surface 108 and the interior surface 72 in a direction normal (or perpendicular) to the interior surface 72 can be least near the bottom end 128 of the insert 100 and greatest near the top portion 132 of the insert 100. In other embodiments, the distance between the second surface 108 and the interior surface 72 in a direction normal (or perpendicular) to the interior surface 72 can be least near the heel end 118 and toe end 114 of the insert 100 and greatest near the center of the insert 100. In other embodiments, the distance between the second surface 108 and the interior surface 72 in a direction normal (or perpendicular) to the interior surface 72 can be least near the bottom end 128, the heel end 118 and the toe end 114 of the insert and can be greatest near the center and top end 132 of the insert 100.

While the embodiment of the insert 100 illustrated in FIGS. 6-9 depicts the first and second surfaces 104, 108 on the insert, in other embodiments the first and/or second surfaces 104, 108 can be positioned on other components of the club head 10.

In one embodiment the first and/or second surfaces 104, 108 can be positioned on the interior surface 72 of the face plate 34. In this embodiment, the first and/or second surfaces 104, 108 can face the insert 100. The insert 100 can have a surface that faces and is spaced from the interior surface 72 that lies in plane 126 (e.g., the facing surface of the insert 100 can have substantially the same profile as the interior surface 72 shown in FIG. 9). A portion of the first surface 104, up to the entirety, can be in contact with the facing surface of the insert 100, while the second surface 108 can be offset from the facing surface of the insert 100. Though positioned on the interior surface 72 instead of the insert 100, the first and/or second surfaces 104, 108 can be substantially as described above, with similar geometry, slope, spacing, angles, and/or distances.

In another embodiment, the first and/or second surfaces 104, 108 can be positioned on a side of the insert 100 that faces the interior surface 80 of the back end 38. Thus, the insert 100 is in contact with the interior surface 72 of the face plate 34, while the gap 144, as previously described, is now between the interior surface 80 and the second surface 108. A portion of the first surface 104, up to the entirety, can be in contact with the interior surface 80, while the second surface 108 is offset from the interior surface 80. The first and/or second surfaces 104, 108 can be substantially as described above, with similar geometry, slope, spacing, angles, and/or distances.

In another embodiment, the first and/or second surfaces 104, 108 can be positioned on the interior surface 80 of the back end 38. In this embodiment, the first and/or second surfaces 104, 108 can face the insert 100. The insert 100 is in contact with the interior surface 72 of the face plate 34, while the gap 144, as previously described, is between the insert 100 and the second surface 108 on the interior surface 80. A portion of the first surface 104, up to the entirety, can be in contact with a facing surface of the insert 100, while the second surface 108 can be offset from the facing surface of the insert 100. Though positioned on the interior surface 80 instead of the insert 100, the first and/or second surfaces 104, 108 can be substantially as described above, with similar geometry, slope, spacing, angles, and/or distances.

IV) Delayed Support Insert

During impact with a golf ball, the face plate 34 of the club head 10 having the insert 100, 300 undergoes deformation or deflection. The face plate 34 deforms or deflects in a travel direction generally towards the rear end 38, i.e., direction 84. The insert the acts as a delayed support is configured such that the face plate 34 continues to deform or deflect until a portion of the gap 144, or the entirety of the gap 144, collapses. For example, the face plate 34 can deform or deflect until the interior surface 72 of the face plate 34 impacts (or comes into contact with) the insert 100, 300, and more specifically impacts the second surface 108, 208 of the insert 100, 300. In other embodiments, a portion of the gap 144 can partially or completely collapse such that a portion of the second surface 108, 208 contacts or supports the interior surface of the face plate 34. In yet other embodiments, a first portion of the gap 144 can partially collapse, while a second portion of the gap 144 can completely collapse. For example, the gap 144, or a portion thereof, can partially collapse (e.g., at a first location of the gap 144 defined by the x-axis 56, y-axis 60, and/or z-axis 64). In addition or alternatively, the gap 144, or a portion thereof, can completely collapse (e.g., at a second location of the gap 144 defined by the x-axis 56, y-axis 60, and/or z-axis 64). The amount and/or location of gap collapse can depend on various factors, including, but not limited to, the golf ball impact location on the face plate 34 (e.g., towards the toe 18, towards the heel 22, towards the crown 26, towards the sole 30, at the "sweet spot," etc.), the swing speed of the golfer, etc.

Once the gap 144 has collapsed, the insert 100, 300 can partially deform to further increase deformation or deflection of the face plate 34. Once the insert 100 can no longer deform, travel of the face plate 34 ceases. Thus, the insert 100, 300 supports the face plate 34 from further deformation or deflection to reduce the risk of reaching irreversible plastic deformation. The face plate 34 and insert 100 then rebound to their respective pre-impact positions (i.e., the gap 144 reforms), generating a desired spring-like effect that results in an increase in golf ball speed and an increase in golf ball travel distance.

In these embodiments, the maximum distance between the second surface 108, 208 and the interior surface 72 of the face plate 34 is smaller than the maximum deflection of the face plate 34. In many embodiments, the maximum distance between the second surface 108, 208 and the interior surface 72 of the face plate 34 can be between 0.010 and 0.060 inches, between 0.010 and 0.050 inches, between 0.010 and 0.040 inches, between 0.010 and 0.030 inches, or between 0.010 and 0.020 inches for the club head 10 having the delayed support 100, 300. For example, the maximum distance between the second surface 108, 208 and the interior surface 72 of the face plate 34 can be less than 0.070 inches, less than 0.060 inches, less than 0.050 inches, less than 0.040 inches, less than 0.030 inches, or less than 0.20 inches for the club head 10 having the delayed support 100, 20. The deflection of the face plate 34 of the club head 10 having the delayed support insert 100, 300 is determined by the material of the face plate 34, the thickness or thickness profile of the face plate 34, the material of the insert 100, 300, and the distance between the second surface 108, 208 and the interior surface 72 of the face plate 34.

To further illustrate operation of the club head 10 having the insert 100, 300 during impact with a golf ball, in an embodiment the maximum thickness of the gap 144 can be 0.0125 inches. During impact, the face plate 34 deforms or deflects 0.0125 inches until the interior surface 72 of the face plate 34 impacts (or comes into contact with) the insert 100, 300, and more specifically impacts the second surface 108 of the insert 100, to collapse the gap 144. The insert 100, 300 can then partially deform by an additional 0.0125 inches, to further increase deformation or deflection of the face plate 34. For example, in some embodiments, the second surface 108 of the insert 100 can deform by an additional 0.0125 inches before supporting the face plate 34 from further deformation. As such, the total deformation or deflection of the face plate 34 is approximately 0.0250 inches.

In other embodiments of the club head 10, the insert 200 comprising a projection can be sufficiently rigid so as to minimally deform when contacted with the face plate 34 at golf ball impact. Accordingly, the insert 200 provides support to the face plate 34 and minimizes further deformation or deflection of the face plate 34 once the gap 208 collapses.

During impact with a golf ball, the face plate 34 of the club head 10 having the projection 200 undergoes deformation or deflection. The face plate 34 deforms or deflects in a travel direction 84 generally towards the back end 38. The face plate 34 continues to deform or deflect until the gap 208 collapses and the contact surface 204 of the projection 200 impacts (or otherwise contacts) the interior surface 80 of the cavity or the interior surface 72 of the face plate 34. Once the contact surface 204 impacts the interior surface 80 or interior surface 72, the projection 200 limits the travel of the face plate 34 by limiting further face plate 34 deformation or deflection. The projection 200 then supports the face plate 34 from further deformation or deflection to reduce the risk of reaching irreversible plastic deformation. The face plate 34 then rebounds to its pre-impact position (i.e., the gap 208 reforms), generating the desired spring-like effect that results in an increase in golf ball speed and an increase in golf ball travel distance.

V) Non-Limiting Insert

During impact with a golf ball, the face plate 34 of the club head 10 having the insert 100 undergoes deformation or deflection. The face plate 34 deforms or deflects in a travel direction generally towards the rear end 38, i.e., direction 84. The insert 100, 300 is configured such that the face deflection on impact is not limited. The face plate 34 will continue to deflect until it reaches a maximum deflection without completely collapsing the gap 144 or contacting the second surface 108, 208 of the insert 100, 300. In these embodiments, the maximum distance between the second surface 108, 208 and the interior surface 72 of the face plate 34 is larger than the maximum deflection of the face plate 34.

In many embodiments, the maximum distance between the second surface 108, 208 and the interior surface 72 of the face plate 34 can be between 0.010 and 0.060 inches, between 0.010 and 0.050 inches, between 0.010 and 0.040 inches, between 0.010 and 0.030 inches, or between 0.010 and 0.020 inches for the club head 10 having the insert 100, 300 comprising a non-limiting support. For example, the maximum distance between the second surface 108, 208 and the interior surface 72 of the face plate 34 can be less than 0.070 inches, less than 0.060 inches, less than 0.050 inches, less than 0.040 inches, less than 0.030 inches, or less than 0.20 inches for the club head 10 having the insert 100, 300 comprising a non-limiting support.

Once the face plate 34 has reached maximum deflection, the face plate 34 rebounds to its pre-impact position without contacting the second surface 108, 208 of the insert 100, 300. The rebounding face plate 34 generates a desired spring-like effect that results in an increase in golf ball speed and an increase in golf ball travel distance. Further, because the face plate 34 is not limited by the insert 100, no impact energy was absorbed by the insert and as such the face plate 34 can rebound to its pre-impact position imparting a greater percentage of the energy from impact back to the ball to increase ball speed and travel distance.

VI) Advantages of Club Head with Insert

The club head 10 having the insert 100, 200, 300 described herein allows increased face deflection on impact compared to a club head 10 having an insert positioned adjacent to the face (i.e. without a gap 144, 208, 344). Increased face deflection can result in increased energy transfer to a golf ball on impact, and therefore increased ball speed and travel distance.

Further, the club head 10 having the insert 100, 200, 300 described herein, wherein a portion of the insert contacts the face plate 34 on impact, dampens vibrations compared to a club head having an insert separated from or not in contact with the face plate. Dampened vibrations due to a portion of the insert contacting the face plate allows the club head to maintain the acoustic properties (e.g. low pitch, deep sound on impact) similar to a club head having insert positioned adjacent to the face. To the contrary, a club head having an insert separated from or not in contact with the face plate can result in an undesired, high pitch sound on impact with a golf ball.

Accordingly, the club head 10 having the insert 100, 200, 300 can balance increased ball speed with acoustic performance of the club head on impact with a golf ball. For example, the club head 10 having the insert 100, 200, 300 simultaneously increases face deflection and ball speed, while maintaining or improving acoustic properties on impact with a golf ball, compared to current club heads having inserts with other configurations.

In many embodiments, the club head 10 having the insert 100, 200, 300 can experience up to 2 miles per hour more ball speed compared to a similar club head having an insert positioned adjacent to the face, while maintaining the low frequency, deep pitch sound on impact of a club head having an insert positioned adjacent to the face.

The vibrations and acoustics of the club head can be measured using a hammer test, whereby a region of the face plate having natural frequency mode is impacted with a hammer and a sensor is used to measure the frequency of oscillation of the club head in response to the impact by the hammer. The hammer test can be used to determine the variance in frequency, vibrations, and/or acoustics of the club head 10 having the insert 100, 200, 300 compared to a similar club head devoid of an insert at least partially contacting the interior surface of the face plate, or compared to a similar club head having an insert fully in contact with the interior surface of the face plate.

VII) Method of Manufacturing

A method of manufacturing a club head 10 having the delayed support 100 is provided. The method includes providing the body 14 having the crown 26, the sole 30, the face plate 34, the hosel 44, and the cavity 68. Next the insert 100 can be positioned in the cavity 68, and can optionally be further attached to one or more of the surfaces 72, 76, 80 that define a portion of the cavity 68 (see FIG. 5).

A method of manufacturing a club head 10 having the delayed support 200 can include providing the body 14 having the crown 26, the sole 30, the face plate 34, the hosel 44, and the cavity 68. The projection 200 can be coupled to one of the opposing interior surfaces 72, 80 that define a portion of the cavity 68 (see FIG. 10), or can be integrally formed with one of the opposing interior surfaces 72, 80 that define a portion of the cavity 68.

The method of manufacturing the club head 10 described herein is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

VIII) Example 1

An exemplary club head 10 is described herein, the exemplary club head 10 having a face plate 34 comprising 17-4 steel, a maximum face plate thickness of 0.105 inches near the center of the face plate, a minimum face plate thickness of 0.095 inches near the perimeter of the face plate, uniform sole thickness of 0.055 inches, and an insert 300 having a maximum distance between the second surface 308 of the insert 300 and the interior surface 72 of the face plate 34 of 0.060 inches, and a percent contact area of the second surface 308 of the insert 300 with the portion of the interior surface of the face plate 34 within the cavity of 2.1%. The exemplary club head 10 experienced approximately 0.035 inches of face deflection and approximately 2 miles per hour increased ball speed compared to a control club head when tested at a swing speed of 92 miles per hour.

In this example the control club head is a similar club head having a face plate comprising 17-4 steel, with a minimum face plate thickness of 0.068 inches near the center of the face plate, a maximum face plate thickness of 0.080 inches near the perimeter of the face plate, uniform sole thickness of 0.055 inches, and an insert 300 having a maximum distance between the second surface of the insert and the interior surface of the face plate of 0.0 inches (e.g. the insert is positioned directly adjacent to the face plate, devoid of a gap), and a percent contact area of the second surface 308 of the insert 300 with the portion of the interior surface of the face plate 34 within the cavity of 100%. The control club head experienced approximately 0.025 inches of face deflection, or 2 miles per hour less ball speed than the exemplary golf club head described herein when tested at a swing speed of 92 miles per hour. Accordingly, the exemplary club head 10 experienced 40% more face deflection on impact with a golf ball, and an additional 2 miles per hour of ball speed, compared to the control club head. In these embodiments, the exemplary and control club heads were heat treated at 1050 degrees Celsius for 1.5 hours, followed by a heat treatment at 550 degrees Celsius for 4 hours, thereby resulting in similar material properties of the exemplary and control face plates.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

Clause 1. A golf club head comprising:
- a body including
- a face plate having a strike surface and an opposing interior surface,
- a rear end, and
- a sole connecting the faceplate with the rear end, wherein the face plate, the rear end, and the sole partially define a cavity; and an insert positioned within the cavity, the insert presenting an insert surface facing the interior surface of the face plate and spaced therefrom.

Clause 2. The golf club head of clause 1, wherein the face plate is configured to deform towards the rear end during impact with a golf ball, and further wherein the insert surface is configured to limit travel of the face plate in response to the impact.

Clause 3. The golf club head of clause 1, wherein the insert surface includes a first end and a second end farther from the sole than the first end, and wherein a distance in a direction normal to the interior surface and between the interior surface and the insert surface is non-constant from the first end to the second end.

Clause 4. The golf club of clause 3, wherein the distance is greater at the second end than at the first end.

Clause 5. The golf club of clause 3, wherein the distance is greatest at the second end.

Clause 6. The golf club of clause 4, wherein a portion of the insert surface is in contact with the interior surface.

Clause 7. The golf club of clause 3, wherein the maximum distance between the interior surface and the insert surface is in the range of 0.005 inches to 0.125 inches.

Clause 8. The golf club of clause 3, wherein the maximum distance between the interior surface and the insert surface is more than 0.075 inches.

Clause 9. A golf club head comprising:

a body including a face plate, a rear end, and a sole connecting the faceplate with the rear end, wherein the face plate, the rear end, and the sole partially define a cavity, the rear end including an interior surface facing the cavity; and an insert positioned within the cavity, the insert presenting an insert surface facing the interior surface of the rear end and spaced therefrom.

Clause 10. The golf club head of clause 9, wherein the face plate is configured to deform towards the rear end during impact with a golf ball, and further wherein the insert surface is configured to limit travel of the face plate in response to the impact.

Clause 11. The golf club head of clause 9, wherein the insert surface includes a first end and a second end farther from the sole than the first end, and wherein a distance in a direction normal to the interior surface and between the interior surface and the insert surface is non-constant from the first end to the second end.

Clause 12. The golf club of clause 11, wherein the distance is greater at the second end than at the first end.

Clause 13. The golf club of clause 11, wherein the distance is greatest at the second end.

Clause 14. The golf club of clause 11, wherein a portion of the insert surface is in contact with the interior surface.

Clause 15. The golf club of clause 11, wherein the maximum distance between the interior surface and the insert surface is in the range of 0.005 inches to 0.125 inches.

Clause 16. The golf club of clause 11, wherein the maximum distance between the interior surface and the insert surface is more than 0.075 inches.

Clause 17. A golf club head comprising:

a body including a face plate having a strike surface and an opposing first interior surface, a rear end, and a sole connecting the faceplate with the rear end, wherein the face plate, the rear end, and the sole partially define a cavity, the rear end including a second interior surface facing the cavity; and a protrusion coupled to one of the first interior surface and the second interior surface, the protrusion presenting a contact surface facing the other of the first interior surface and the second interior surface and spaced therefrom.

Clause 18. The golf club head of clause 17, wherein the face plate is configured to deform towards the rear end during impact with a golf ball, and further wherein the contact surface is configured to limit travel of the face plate in response to the impact.

Clause 19. The golf club of clause 17, wherein a distance between the contact surface and the other of the first interior surface and the second interior surface is no greater than 0.04 inches Clause 20. The golf club of clause 17, wherein the protrusion is integrally formed as one piece with the one of the first interior surface and the second interior surface.

The invention claimed is:

1. A golf club head comprising:

a body including:

a face plate having a strike surface and an opposing interior surface, wherein a distance between the strike surface and the opposing interior surface of the face plate defines a thickness of the face plate, and the thickness of the face plate is uniform;

a rear end; and a sole connecting the face plate with the rear end, wherein the opposing interior surface of the face plate, an interior surface of the rear end, and an interior surface of the sole partially define a cavity; and an insert positioned within the cavity, the insert comprising:

a first end configured to contact the entire interior surface of the sole;

a second end opposite the first end; and a front portion configured to face the opposing interior surface of the face plate, the front portion having:

a first insert surface in contact with the opposing interior surface of the face plate and positioned between the first end and the second end; and a second insert surface positioned adjacent and offset from the first insert surface;

wherein the second insert surface is spaced apart from the opposing interior surface of the face plate defining a distance between the second insert surface and the opposing interior surface of the face plate; and wherein the distance between the second insert surface and the opposing interior surface of the face plate ranges from 0.005-0.060 inch.

2. The golf club head of claim 1, wherein the second insert surface includes a taper angle such that the distance between the second insert surface and the opposing interior surface of the face plate, in a direction normal to the second insert surface, increases from near the first end to the second end.

3. The golf club head of claim 2, wherein the taper angle is between 0.01°-20°.

4. The golf club head of claim 1, wherein the second insert surface is concave relative to the face plate in a direction extending from near a bottom surface of the insert to near a top surface of the insert, and in a direction extending from near a heel end of the insert to near a toe end of the insert.

5. The golf club head of claim 4, wherein the first insert surface is a U-shape comprising:

a cross-member extending from the heel end of the insert to the toe end of the insert, adjacent to the bottom surface; and a first arm adjacent to the heel end of the insert and a second arm adjacent to the toe end of the insert, the first and second arms extending at least partially from the bottom surface of the insert to the top surface of the insert.

6. The golf club head of claim 1, wherein the first insert surface is in contact with 0.5-10% of the opposing interior surface of the face plate within the cavity.

7. The golf club head of claim 1, wherein the face plate is configured to deform towards the rear end during impact with a golf ball, and further wherein the first insert surface is configured to limit travel of the face plate during impact.

8. The golf club head of claim 1, wherein the face plate is configured to deform towards the rear end during impact with a golf ball, wherein the face plate does not contact the second insert surface of the insert during impact.

9. The golf club head of claim 1, wherein the sole of the club head comprises a uniform thickness less than 0.060 inch.

10. A golf club head comprising:

a body including:

a face plate having a strike surface and an opposing interior surface, wherein a distance between the strike surface and the opposing interior surface of the face plate defines a thickness of the face plate, and the thickness of the face plate is uniform;

a rear end; and a sole connecting the face plate with the rear end, wherein the opposing interior surface of the face plate, an interior surface of the rear end, and an interior surface of the sole partially define a cavity; and an insert positioned within the cavity, the insert comprising:

a first end configured to contact the entire interior surface of the sole;

a second end opposite the first end; and a front portion configured to face the opposing interior surface of the face plate, the front portion having:

a first insert surface having one or more ribs or protrusions in contact with the opposing interior surface of the face plate and positioned between the first end and the second end; and a second insert surface positioned adjacent and offset from the first insert surface, wherein the second insert surface is spaced apart from the opposing interior surface of the face plate;

wherein a distance between the second insert surface and the opposing interior surface of the face plate ranges from 0.005-0.060 inch.

11. The golf club head of claim 10, wherein the second insert surface includes a taper angle such that the distance between the second insert surface and the opposing interior surface of the face plate, in a direction normal to the second insert surface, increases from near the first end to the second end.

12. The golf club head of claim 11, wherein the taper angle is between 0.01°-20°.

13. The golf club head of claim 10, wherein the second insert surface is concave relative to the face plate in a direction extending from near a bottom surface of the insert to near a top surface of the insert, and in a direction extending from near a heel end of the insert to near a toe end of the insert.

14. The golf club head of claim 13, wherein the first insert surface comprises a first arm adjacent to the heel end of the insert and a second arm adjacent to the toe end of the insert, the first and second arms extending at least partially from the bottom surface of the insert to the top surface of the insert.

15. The golf club head of claim 10, wherein the first insert surface is in contact with 0.5-10% of the opposing interior surface of the face plate within the cavity.

16. The golf club head of claim 10, wherein the sole of the club head comprises a uniform thickness less than 0.060 inch.

* * * * *